US011122351B2

(12) United States Patent
Struzik

(10) Patent No.: US 11,122,351 B2
(45) Date of Patent: Sep. 14, 2021

(54) OPEN AUDIO DEVICE

(71) Applicant: Bose Corporation, Framingham, MA (US)

(72) Inventor: Ryan C. Struzik, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/553,751

(22) Filed: Aug. 28, 2019

(65) Prior Publication Data

US 2021/0067857 A1 Mar. 4, 2021

(51) Int. Cl.

*H04R 1/10* (2006.01)
*H04R 1/34* (2006.01)
*H04R 1/02* (2006.01)

(52) U.S. Cl.

CPC ..... *H04R 1/1008* (2013.01); *H04R 1/023* (2013.01); *H04R 1/1075* (2013.01); *H04R 1/345* (2013.01); *H04R 2460/09* (2013.01)

(58) Field of Classification Search

CPC . H04R 1/00; H04R 1/02; H04R 1/021; H04R 1/023; H04R 1/10; H04R 1/1008; H04R 1/105; H04R 1/1075; H04R 1/20; H04R 1/22; H04R 1/28; H04R 1/2803; H04R 1/2807; H04R 1/2811; H04R 1/2823; H04R 1/2826; H04R 1/2846; H04R 1/2849; H04R 1/2853; H04R 1/2857; H04R 1/2869; H04R 1/2873; H04R 1/2876; H04R 1/288; H04R 1/2884; H04R 1/2888; H04R 1/2892; H04R 1/2896; H04R 1/32; H04R 1/323; H04R 1/34; H04R 1/345; H04R 2201/00; H04R 2460/09; H04R 2460/11; H04R 1/347; H04R 2201/02; H04R 2201/029; H04R 2201/10; H04R 2201/103; H04R 2201/105; H04R 2201/109

See application file for complete search history.

(56) References Cited

U.S. PATENT DOCUMENTS

| | | | | |
|---|---|---|---|---|
| 6,301,367 | B1 * | 10/2001 | Boyden | A42B 1/245 2/209 |
| 2017/0064435 | A1 * | 3/2017 | Jetter | H04R 3/04 |
| 2018/0033419 | A1 * | 2/2018 | Shetye | H04R 1/1083 |
| 2018/0167710 | A1 * | 6/2018 | Silver | H04R 1/1075 |
| 2018/0295455 | A1 * | 10/2018 | Eichfeld | H04R 25/305 |
| 2020/0178003 | A1 * | 6/2020 | Zurbruegg | H04R 1/2842 |

FOREIGN PATENT DOCUMENTS

| | | | | |
|---|---|---|---|---|
| EP | 3637789 | A1 * | 4/2020 | H04R 25/604 |

* cited by examiner

*Primary Examiner* — Walter F Briney, III
(74) *Attorney, Agent, or Firm* — Brian M. Dingman; Dingman IP Law, PC

(57) ABSTRACT

An open audio device that includes an acoustic radiator that emits front-side acoustic radiation from its front side and emits rear-side acoustic radiation from its rear side, a front acoustic cavity that receives front-side acoustic radiation, a front transmission line that is acoustically coupled to the front acoustic cavity and comprises a first front sound-emitting opening, and a rear acoustic cavity that receives rear-side acoustic radiation and comprises at least a first rear sound-emitting opening.

18 Claims, 7 Drawing Sheets

OPEN AUDIO DEVICE

BACKGROUND

This disclosure relates to an open audio device.

Open audio devices allow the user to be more aware of the environment, and provide social cues that the wearer is available to interact with others. However, since the acoustic transducer(s) of open audio devices are spaced from the ear and do not confine the sound to the just the ear, open audio devices produce more sound spillage that can be heard by others as compared to on-ear headphones. Spillage can detract from the usefulness and desirability of open audio devices.

SUMMARY

All examples and features mentioned below can be combined in any technically possible way.

In one aspect, an open audio device includes an acoustic radiator that emits front-side acoustic radiation from its front side and emits rear-side acoustic radiation from its rear side, a front acoustic cavity that receives front-side acoustic radiation, a front transmission line that is acoustically coupled to the front acoustic cavity and comprises a first front sound-emitting opening, and a rear acoustic cavity that receives rear-side acoustic radiation and comprises at least a first rear sound-emitting opening.

Examples may include one of the above and/or below features, or any combination thereof. The open audio device may further comprise a second front sound-emitting opening that comprises a resistive element and is closer to the acoustic radiator than is the first front sound-emitting opening. The first rear sound-emitting opening may comprise a resistive element.

Examples may include one of the above and/or below features, or any combination thereof. The open audio device may further comprise a support structure that is configured to carry the acoustic radiator on a wearer's head such that the acoustic radiator is held proximate but not in an ear canal opening of the user. The open audio device may further comprise a housing that is carried by the support structure, wherein the housing contains the acoustic radiator and defines at least part of the front and rear acoustic cavities. At least part of the front transmission line may comprise a spout piece that is configured to be removably coupled to the housing. The spout piece may be configured such that when it is coupled to the housing it covers at least a portion of at least one rear sound-emitting opening. The rear acoustic cavity may comprise first and second rear sound-emitting openings, and at least one of the first and second rear sound-emitting openings may comprise a resistive element. The open audio device may further comprise a processor that is configured to provide audio signals to the acoustic radiator. The processor may be configured to modify the audio signals based on whether the spout piece is coupled to the housing.

Examples may include one of the above and/or below features, or any combination thereof. The front transmission line may be configured to locate the first front sound-emitting opening proximate but not in the ear canal opening. The front transmission line may have a length and is curved along its length such that it is configured to pass over the ear tragus and locate the first front sound-emitting opening near but not in the ear canal opening. The first front sound-emitting opening may be configured to direct sound generally near the ear canal opening.

Examples may include one of the above and/or below features, or any combination thereof. The open audio device may further comprise a second rear sound-emitting opening that is configured to be closer to the ear canal than and located apart from the first rear sound-emitting opening. At least one front sound-emitting opening may comprise a resistive element. A front resistive element may comprise a resistive screen. At least one rear sound-emitting opening may comprise a resistive element. A rear resistive element comprises a resistive screen. The open audio device may further comprise a resistive opening that acoustically couples the front and rear acoustic cavities. The open audio device may further comprise a housing that contains the acoustic radiator and is configured to be held on or proximate an ear of a user.

In another aspect, an open audio device includes an acoustic radiator that emits front-side acoustic radiation from its front side and emits rear-side acoustic radiation from its rear side, a support structure that is configured to carry the acoustic radiator on a wearer's head such that the acoustic radiator is held proximate but not in an ear canal opening of the user, a front acoustic cavity that receives front-side acoustic radiation and comprises a first front sound-emitting opening, a front transmission line that is acoustically coupled to the front acoustic cavity and comprises the first front sound-emitting opening, wherein the front transmission line is configured to locate the first front sound-emitting opening proximate but not in the ear canal opening, a rear acoustic cavity that receives rear-side acoustic radiation and comprises at least a first rear sound-emitting opening, and a housing that is carried by the support structure, wherein the housing contains the acoustic radiator and defines at least part of the front and rear acoustic cavities. At least part of the front transmission line may comprise a spout piece that is configured to be removably coupled to the housing.

DETAILED DESCRIPTION

Figure 1:
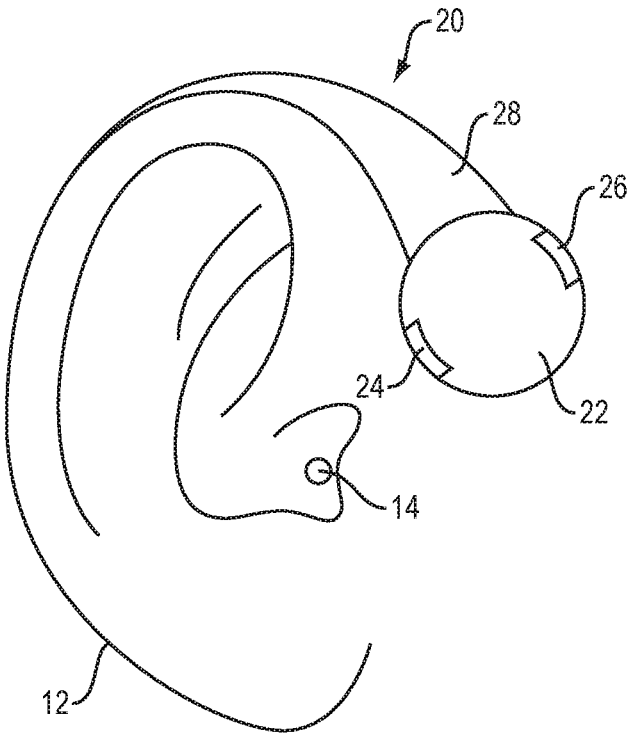
FIG. 1 illustrates an open audio earphone device on an ear.

Open audio devices, such as those described in U. S. Patent Publication 2018-0167710, filed on Dec. 11, 2016

(the entire disclosure of which is incorporated herein by reference for all purposes) typically include an electro-acoustic transducer (i.e., a driver) with front and rear sides. In some non-limiting examples the front side sound exits the device near the user's ear canal, and the rear side sound exits farther from the user's ear canal. In other examples, the front side sound exits the device closer to the ear than does the rear side sound. At low frequencies, the sound from the front and rear sides are nearly equal in amplitude and out-of-phase (and so cancel in the far field), such that the device behaves approximately like a dipole. Accordingly, little sound is spilled to people who may be nearby.

Because the driver basket or the housing that contains the driver has some acoustic volume and at least one opening on each of the front and rear sides, resonances occur on both the front and the rear. When resonance occurs in the front or rear acoustic volume the sound pressure level (SPL) radiated from the opening from that volume increases. When resonances occur on the front and rear at substantially different frequencies, more sound radiates from one opening such that the dipole behavior no longer occurs at and above the resonant frequencies, and higher objectionable spillage occurs.

The present disclosure includes an open audio device of the type described in the patent application incorporated by reference. One manner by which low spillage can be accomplished in the open audio device with an acoustic transmission line coupled to an acoustic volume is with a housing that is configured such that the front and rear primary (i.e., fundamental) acoustic resonance frequencies are matched as closely as possible, given other product design constraints. In one non-limiting example the fundamental resonances are matched to some tolerance (e.g., within one octave of each other). For a simple dipole housing (e.g., with a single outlet opening in each of the front and rear acoustic cavities), this can be accomplished by adjusting the volumes and/or lengths of the front and rear acoustic cavities and the areas and/or lengths of their respective openings, so the resonances are nearly matched. Generally, though not necessarily, the front and rear cavity volumes are made small so that the overall device is compact, which can lead to greater user comfort. Generally, though not necessarily, the opening areas are often made as large as allowable so that resonances occur at as high of a frequency as possible (which thus maintains low spillage up to the resonance frequencies), while maintaining that the openings direct sound at the appropriate locations (e.g., the front opening at the end of the transmission line is near the ear canal, and the rear opening is substantially farther away from the ear canal so there is less sound cancellation at the ear).

An electro-acoustic transducer includes an acoustic element (e.g., a diaphragm) that emits front-side acoustic radiation from its front side and emits rear-side acoustic radiation from its rear side. A housing or other structure (e.g., the transducer basket) directs the front-side acoustic radiation and the rear-side acoustic radiation. A plurality of sound-emitting vents in this structure (at least one in the front and one in the rear) allow sound to leave the structure. One such vent or opening is in the acoustic transmission line that is coupled to the front or rear acoustic volume. The electro-acoustic transducer is able to achieve an appropriate ratio of sound pressure delivered to the ear to spilled sound.

This disclosure describes a type of open audio device with one or more electro-acoustic transducers that are located off of the ear. A headphone refers to a device that typically fits around, on, or in an ear and that radiates acoustic energy into the ear canal. Headphones are sometimes referred to as earphones, earpieces, headsets, earbuds, or sport headphones, and can be wired or wireless. A headphone includes an electro-acoustic transducer (driver) to transduce audio signals to acoustic energy. The acoustic driver may or may not be housed in an earcup. The figures and descriptions following in some cases show a single open audio device. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around the ear or on the ear or off the ear headphone, the headphone may include a headband or other support structure and at least one housing or other structure that contains a transducer and is arranged to sit on or over or proximate an ear of the user. The headband can be collapsible or foldable, and can be made of multiple parts. Some headbands include a slider, which may be positioned internal to the headband, that provides for any desired translation of the housing. Some headphones include a yoke pivotably mounted to the headband, with the housing pivotally mounted to the yoke, to provide for any desired rotation of the housing.

An open audio device includes but is not limited to off-ear headphones (i.e., devices that have one or more electro-acoustic transducers that are coupled to the head or ear (typically by a support structure) but do not occlude the ear canal opening), and audio devices carried by the upper torso, e.g., the shoulder region. In the description that follows the open audio device is depicted as an off-ear headphone, but that is not a limitation of the disclosure as the electro-acoustic transducer can be used in any device that is configured to deliver sound to one or both ears of the wearer where there are no ear cups and no ear buds.

FIG. 1 illustrates open audio device 20 mounted on ear 12 and/or the head proximate the ear. Device 20 may be considered an earphone. It includes acoustic module 22 that includes at least one electro-acoustic transducer, front acoustic volume sound-emitting opening 24 (which is close to but not on or in ear canal opening 14) and rear acoustic volume sound-emitting opening 26 (which is typically but not necessarily located as far as possible from front opening 24). Acoustic module 22 is carried by support structure 28, which is configured to be mounted on ear 12 and/or the portion of the head proximate the ear. Open audio devices with an acoustic module located in front of the ear and carried by a support structure that is configured to be on the ear or head are known in the field and so are not further described herein in detail.

Figure 2:
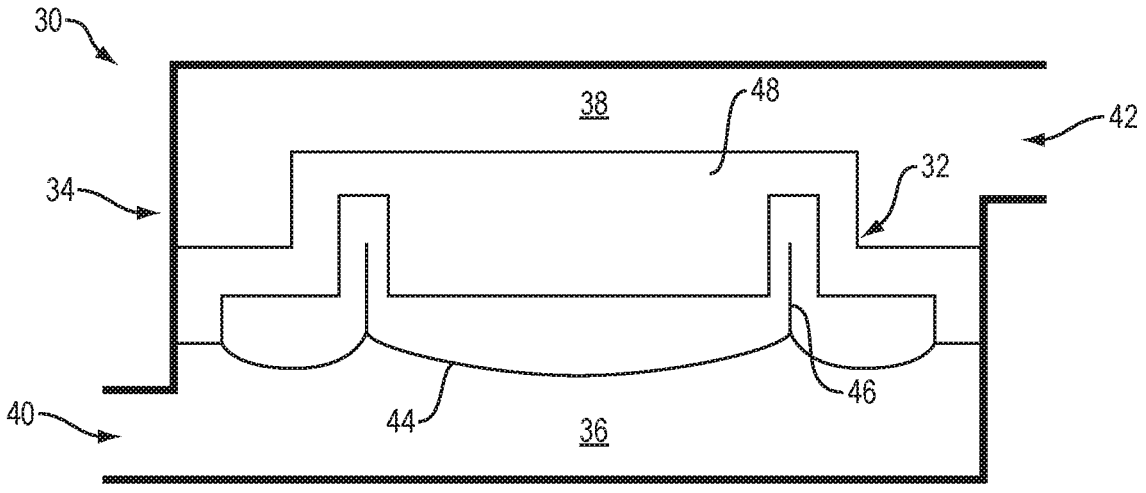
FIG. 2 is a schematic cross-sectional diagram of an open audio device.

An exemplary dipole-like open audio device acoustic module 30 is depicted in FIG. 2. Module 30 includes transducer 32 that is located within housing 34. Transducer 32 comprises diaphragm 44 that is moved by interaction of coil 46 with a magnetic field generated by the magnetic system, represented generally as structure 48. Structure 48 may also include a basket and may be vented to the rear acoustic cavity 38. Electro-acoustic transducer design and operation are well understood by those skilled in the field and so are not fully described herein. Front-side acoustic radiation enters front acoustic cavity 36 and rear-side acoustic radiation (which is out of phase with the front side radiation) enters rear acoustic cavity 38. Sound exits front cavity 36 via opening 40 and sound exits rear cavity 38 via opening 42. As described in more detail in the patent application incorporated by reference herein, since the sound exiting openings 40 and 42 is out of phase, it cancels in the far field. This dipole-like behavior leads to a reduction in spilled sound that can be heard by others who are near the user of device 30. Also, since opening 40 is relatively close to the ear, its sound will mainly reach the ear before it is canceled by sound from opening 42. Accordingly, audio device 30 is enabled to both deliver sound to the user and reduce spilled sound that is able to be heard by others.

Figure 3:
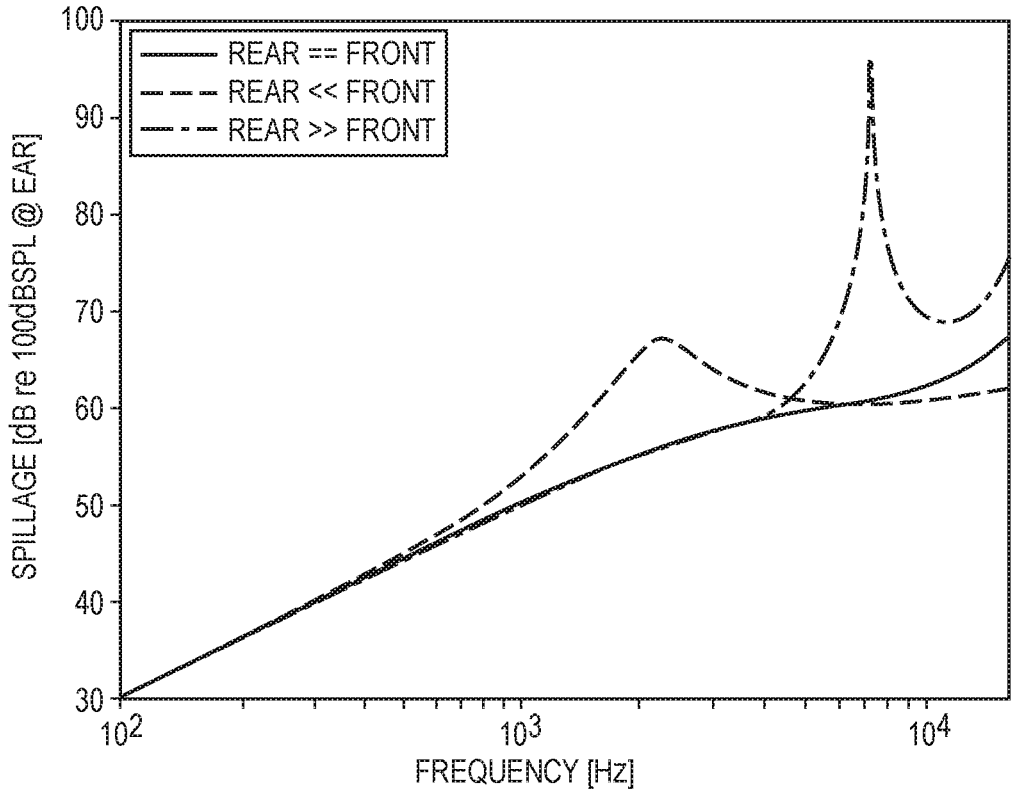
FIG. 3 illustrates sound spillage from the open audio device of FIG. 2.

As described above, front and rear cavities 36 and 38 and their respective openings 40 and 42 each behave acoustically to exhibit a fundamental resonance frequency. At and above this frequency the sound pressure exiting the cavity opening will increase. If the resonance frequencies of the two cavities are quite different this leads to imbalances in the SPL emitted from the front and rear openings, which leads to increased sound spillage. Exemplary spillage data is set forth in FIG. 3, wherein the sound spilled to bystanders (located one meter from the acoustic module) relative to the sound heard by the wearer (as dB spillage when 100 dB SPL is delivered to the ear) is plotted vs. frequency. The solid line plot is for when the rear resonance frequency is equal to the front resonance frequency, while the dashed line is for the rear resonance frequency much lower than the front, and the dash-dot line is for the rear resonance frequency much higher than the front. The best (lowest) spillage occurs when the resonance frequencies are nearly equal (i.e., equal to within about one octave or less). When the rear resonance frequency is much less, there is a broadband increase in spillage shown in the frequency range of about 500 Hz to 6 kHz in this example. When the rear resonance frequency is much higher, there is a peak in spillage shown in the frequency range of about 4 kHz and above in this example.

Figure 4:
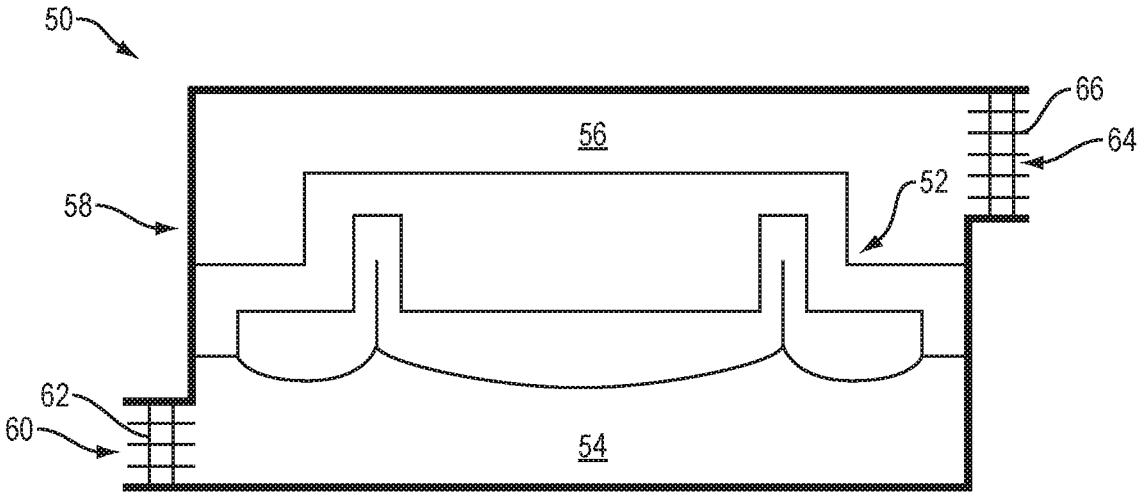
FIG. 4 is a schematic cross-sectional diagram of an open audio device.

Note that either the front or rear openings may have a resistive element such as a screen, as with acoustic module 50, FIG. 4. Resonances can be damped by resistance elements, which can facilitate matching the front and rear acoustic radiation by making the resonant peaks less sharp so misalignment of resonant frequencies results in less difference between the front and rear acoustic radiation. Another manner of damping a resonance is with a Helmholtz resonator (not shown) coupled to a volume. In some examples, the resonator may include distinct port and volume elements or may be formed by a waveguide of either constant or non-constant cross-sectional area. The resonator may include a resistive element such as a resistive screen or porous foam. Acoustic module 50 includes transducer 52 that is located within housing 58. Transducer 52 radiates front-side acoustic radiation into front acoustic cavity 54 and rear-side acoustic radiation into rear acoustic cavity 56. Sound exits front cavity 54 via opening 60 and sound exits rear cavity 56 via opening 64. Opening 60 is covered by resistive element 62 (which may be but need not be a resistive cloth) and opening 64 is covered by resistance element 66. Note that only one of the openings might be covered by a resistance element. A resistance element can be beneficial for spillage, particularly if the rear opening has a resistive element, as the element can help damp the rear resonance and minimize additional sound radiated from the rear when the rear is not matched to the front resonance frequency. However, the resistance element in this example can also damp the transducer and reduce the efficiency at the transducer's resonance frequency. Beside adding resistance, either of screens 62 and 66 may be used primarily to prevent ingress of foreign material.

One or more openings may be used on the front and/or the rear sides. Using multiple openings in parallel can be a way to increase the resonance frequency to facilitate matching the front and rear. Also, a resistive element may be used on one or more of the multiple openings. It may be useful to use a higher resistance element on one of the multiple openings to help damp the respective cavity resonance without damping the transducer resonance.

Figure 5:
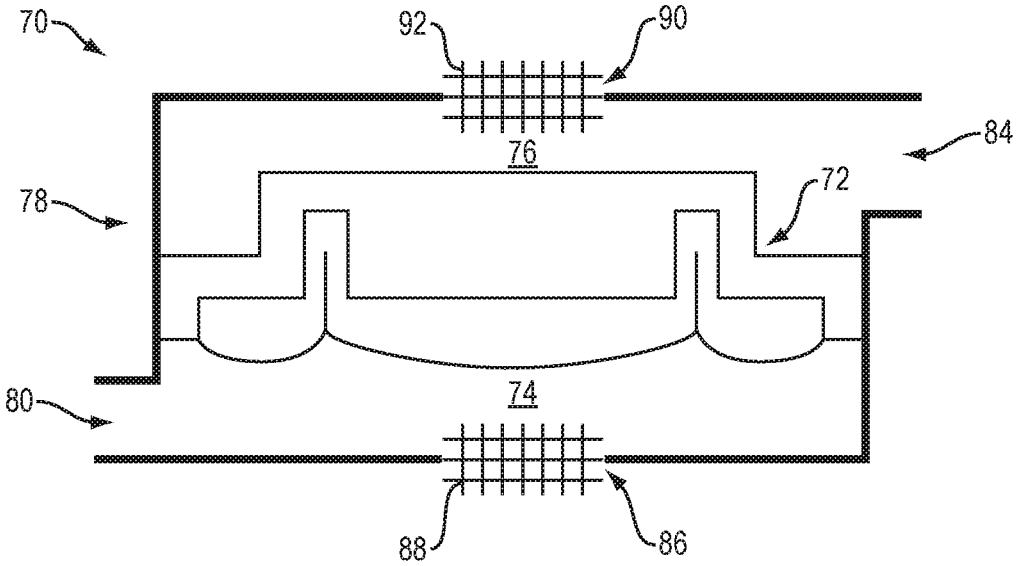
FIG. 5 is a schematic cross-sectional diagram of an open audio device.

An example is shown in FIG. 5. Acoustic module 70 includes transducer 72 that is located within housing 78. Transducer 72 radiates front-side acoustic radiation into front acoustic cavity 74 and rear-side acoustic radiation into rear acoustic cavity 76. Sound exits front cavity 74 via opening 80 and can also exit via opening 86 that is covered by a resistance element 88. Sound exits rear cavity 76 via opening 84 and can also exit via opening 90 that is covered by a resistance element 92. Note that only one of the openings 86 and 90 might be covered by a resistance element. Elements 88 and 92 help to damp resonances in cavities 74 and 76, respectively. Also, one or both of the front and rear acoustic cavities may have more than one resistive opening. For example, there could be two smaller resistive openings instead of one larger resistive opening. For instance, circumferentially the main opening or nozzle may be located at zero degrees, with two resistive openings, one at +90 degrees and one at −90 degrees. In some examples, screens (not shown) may also be placed over either or both openings 80 and 84 to prevent ingress of foreign material.

There can be one, two, or more, openings in one or both of the front and rear acoustic cavities. One opening generally acts as the egress for sound pressure, although two or more (generally smaller) openings could replace a single such opening. Likewise, one opening may be resistive, to help damp cavity resonances, although two or more (generally smaller) resistive openings could replace a single such opening. For the front cavity, it is more important that the non-resistive or low-resistance opening (i.e., the nozzle) is close to the car canal and that the resistive opening is farther from the ear canal but also (by necessity) away from the nozzle such that at resonance the resistive opening is in a high pressure location to be able to effectively shunt/damp the resonance. As such, the resistive opening could indeed be near the radiator (as with resistive opening 88, FIG. 5), but it could also be along the circumference on the side opposite the nozzle opening 80. Likewise, for the back cavity it is more important that the non-resistive/low-resistance opening is far from the ear canal, so as not to cancel bass at the ear, and that the resistive opening is away from the non-resistive opening, such that at resonance the resistive opening is in a high pressure location to be able to shunt/damp the resonance. The back resistive opening can also be located closer to the ear canal than the back non-resistive opening, in order to make a shorter dipole for better high-frequency spillage. As such, the resistive opening 90 could be near the radiator (as in FIG. 5), but it could also be along the circumference on the side opposite opening 84.

Figure 6:
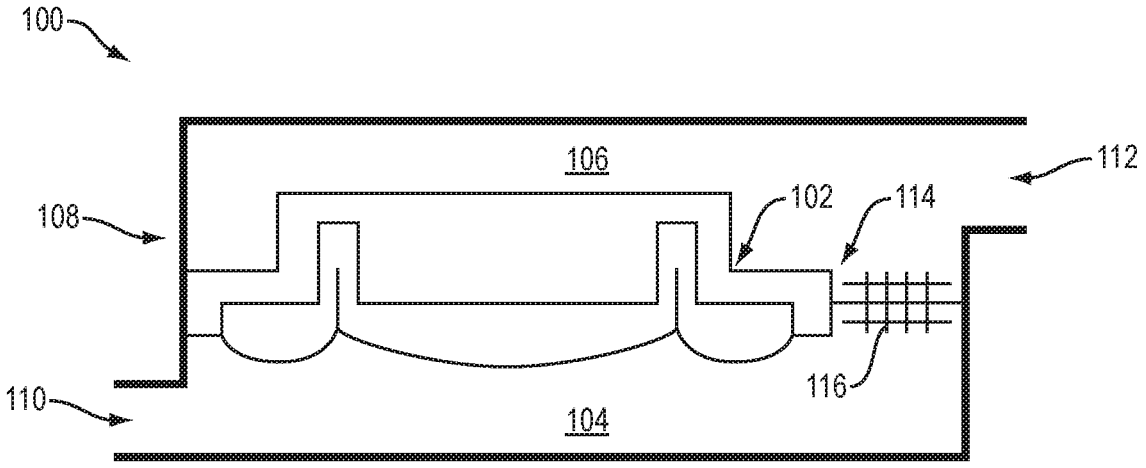
FIG. 6 is a schematic cross-sectional diagram of an open audio device.

It is also possible to damp both the front and rear resonances with a resistance element within the housing and connecting the front and rear cavities, sometimes called a pressure equalization or PEQ port. PEQ ports are further described in U.S. Pat. No. 8,989,427, issued on Mar. 24, 2015. An example of a transducer with a PEQ port is shown in FIG. 6. Acoustic module 100 includes transducer 102 that is located within housing 108. Transducer 102 radiates front-side acoustic radiation into front acoustic cavity 104 and rear-side acoustic radiation into rear acoustic cavity 106.

Sound exits front cavity 104 via opening 110. Sound exits rear cavity 106 via opening 112. Internal opening 114 connects cavities 104 and 106 and is covered by resistance element 116. The resistance element 116 can be sufficiently resistive to prevent low frequencies from leaking between cavities 104 and 106 so bass output to the ear canal is maintained, but open enough to damp resonances in both the front cavity 104 and rear cavity 106. In some examples, the opening 114 and resistance element 116 may be part of the housing 108 or part of the transducer 102, such as a portion of the basket or as a portion of the diaphragm. In some examples, the opening 114 and resistance element 116 may be formed from an opening with an attached resistive screen or from a perforated section of material.

Figure 7:
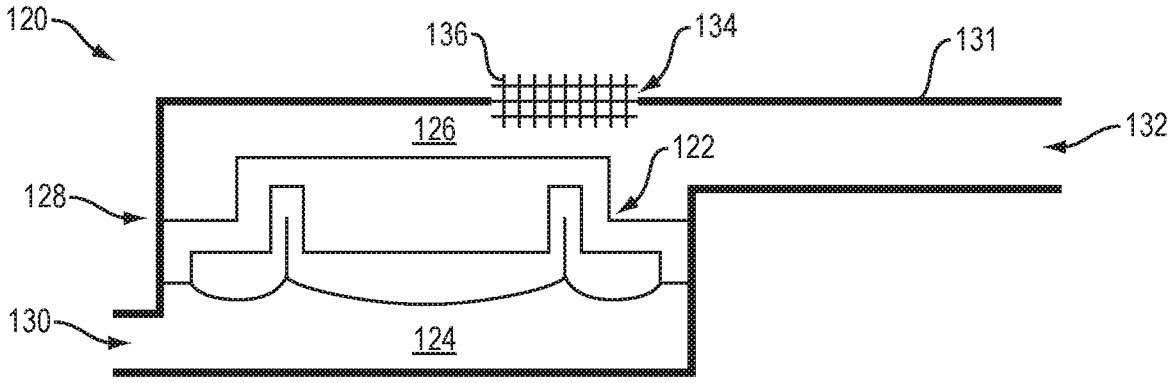
FIG. 7 is a schematic cross-sectional diagram of an open audio device.

One or more of the openings in the front and/or rear cavities may be through an acoustic transmission line or waveguide in the housing. The transmission line may be beneficial in the audio device design as an element that can be smaller than the transducer and can direct either the front or rear side sound to a more optimal location. For instance, FIG. 7 illustrates acoustic module 120 that includes transducer 122 that is located within housing 128. Transducer 122 radiates front-side acoustic radiation into front acoustic cavity 124 and rear-side acoustic radiation into rear acoustic cavity 126. Sound exits front cavity 124 via opening 130. Sound exits rear cavity 126 via opening 132 which is at the end of acoustic transmission line 131 and so is farther from the transducer than is opening 130. Second rear opening 134 is covered by resistance element 136. An acoustic transmission line (with or without a second, resistive opening) can also or alternatively be coupled to the front acoustic cavity. The acoustic module topology is similar to the variable length dipole (VLD) disclosed in the patent application that is incorporated herein by reference. An aspect of the VLD is that, in addition to achieving the frequency-dependent dipole behavior, the optimal spillage is achieved by tuning to match the front and rear resonance frequencies as described herein. In this configuration, matching the front and rear resonance frequencies can be accomplished by adjusting the volumes and/or lengths of the front and rear acoustic cavities and the areas and/or lengths of their respective openings, so the resonances are nearly matched. Furthermore, the resistance of rear opening screen 136 can be adjusted to shift and damp the rear resonance. For instance, in the limiting case where resistance 136 was low to be effectively open, the total rear opening area is large leading to a higher resonance frequency, while in the limiting case where resistance 136 is high to be effectively closed, the total rear opening area is low leading to a lower resonance frequency. Adjustment of the resistance 136 to a moderate effective resistance can shift the rear resonance in between these extremes and damp it. In some instances, this resistance must also be balanced with its effect on the frequency-dependent dipole behavior. Generally, though not necessarily, the front and rear cavity volumes are made small so that the overall device is compact, which can lead to greater user comfort. Generally, though not necessarily, the opening areas are often made as large as allowable so that resonances occur at as high of a frequency as possible (which thus maintains low spillage up to the resonance frequencies), while maintaining that the openings direct sound at the appropriate locations (e.g., the front opening is near the ear canal and the rear openings are substantially farther from the ear canal so there is less sound cancellation at the ear).

The resistive element(s) disclosed herein can be used to damp the rear resonance in order to minimize sound radiated from the rear opening(s). Such damping can be particularly useful in a ported rear cavity design such as shown in FIG. 7 since the port can lower the rear resonance frequency, which could otherwise lead to a greater front to rear resonance mismatch and so greater spilled sound.

As one non-limiting example of the use of a design like that in FIG. 7, the open audio device may be configured to place a small transducer in the cymba concha of the outer ear, with the front opening 130 very close to the ear canal. Rear port 131 is used to direct rear sound farther from the ear canal. Preferably but not necessarily, rear opening 132 is configured to be located such that it is not over the outer ear. A rear resistive element (such as element 136) may be needed on the rear side to increase and damp the rear resonance frequency in order to decrease spillage.

Desired matching of the front and rear resonances (e.g., to within the stated tolerance) can be measured using a probe microphone that measures the pressure at each of the openings while the transducer is excited to determine if the front and rear resonances were matched. Measurements could also be made by driving the transducer directly and measuring the resultant sound pressure per volt. Alternatively, the transducer cone movements could be measured by a laser, and the pressure per cone velocity could be measured to determine the resonances.

Figure 8:
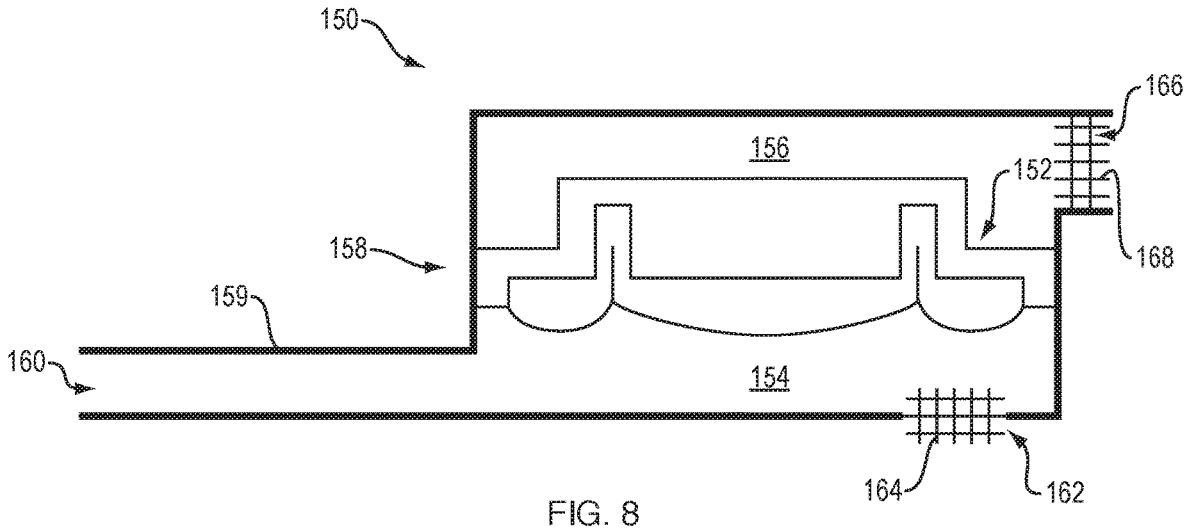
FIG. 8 is a schematic cross-sectional diagram of an open audio device.

FIG. 8 illustrates acoustic module 150 that includes transducer 152 that is located within housing 158. Transducer 152 radiates front-side acoustic radiation into front acoustic cavity 154 and rear-side acoustic radiation into rear acoustic cavity 156. Sound exits front cavity 154 via sound-emitting opening 160 that is at the end of acoustic transmission line 159. Front cavity 154 also includes optional second sound-emitting opening 162 with resistance element 164. Sound exits rear cavity 156 via opening 166 that is covered by resistance element 168. Transmission line 159 in part functions to deliver front side sound farther from the transducer. In one non-limiting example opening 160 can be located closer to the ear canal entrance than housing 158. This allows the housing to be held off the ear while front side sound is still delivered close to the ear canal.

Figure 9A:
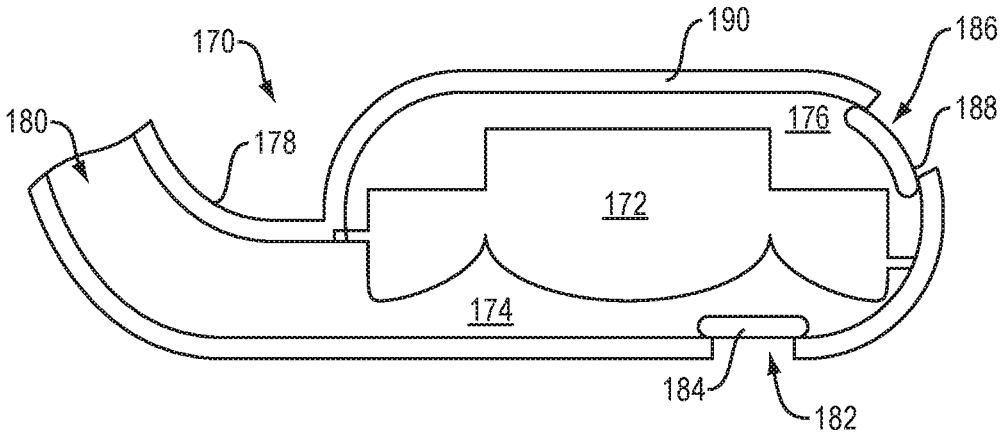
FIG. 9A is a cross-sectional illustration of an open audio device.
Figure 9B:
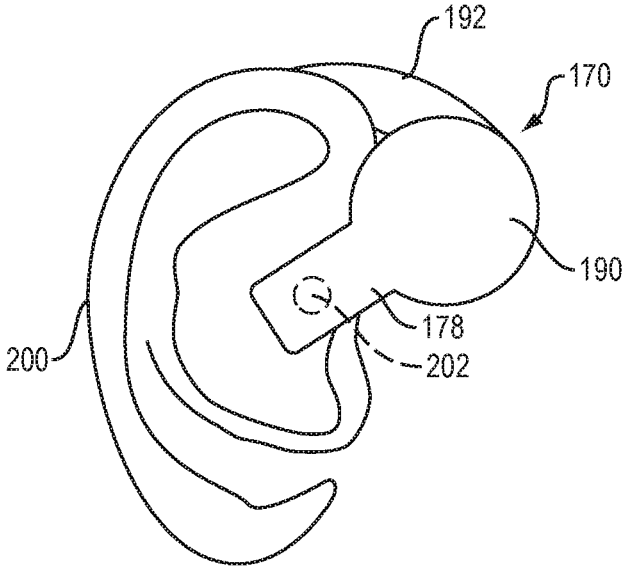
FIG. 9B shows the open audio device of FIG. 9A mounted near an ear.

FIGS. 9A and 9B illustrate acoustic module 170 that includes transducer 172 that is located within housing 190. Transducer 172 radiates front-side acoustic radiation into front acoustic cavity 174 and rear-side acoustic radiation into rear acoustic cavity 176. Sound exits front cavity 174 via sound-emitting opening 180 that is at the end of curved transmission line 178. Opening 180 may have a screen over it that could be resistive, or it could prevent ingress of foreign material. Front cavity 174 also includes optional second sound-emitting opening 182 with resistance element 184 (e.g., an acoustically-resistive cloth) covering the opening. Sound exits rear cavity 176 via opening 186 that can be but need not be covered by resistance element 188. Transmission line 178 in part functions to deliver front side sound farther from the transducer. As shown in FIG. 9B, housing 190 can be held just in front of ear 200. The housing can be carried by support structure 192 that is configured to be coupled to or held against the ear and/or the portion of the head near the ear, as is known in the field. Transmission line 178 is directed toward ear canal opening 202, and places opening 180 over or very close to the ear canal opening without blocking it. In one non-limiting example opening 180 can be located closer to the ear canal entrance than housing 190. This allows the housing to be held off the ear while front side sound is still delivered very close to the ear canal. Also, increasing the distance between the front and rear openings, and locating the front opening very close to the ear canal, decreases cancellation of sound before it reaches the ear.

In cases such as depicted in FIGS. 9A and 9B where one of the front openings is in a transmission line in the housing, a purpose of this transmission line, or spout, is that it is smaller than the housing and can thus direct front sound closer to the ear canal. It can also do so without contacting the ear by hovering over the concha and thus still be comfortable, as in FIG. 9B. Being more proximate to the ear canal can more efficiently deliver sound to the ear, while still enabling the ear to be aurally open. Note that the transmission line can have any desired shape, length, or construction, and the front and/or rear openings/ports can be configured as shown in other drawings and as further described herein. In this design, a second resistive opening 182 is included on the front to shift the front resonance frequency higher (since the spout shifts it low), and opening 182 has a resistive element 184 to damp it. In other designs, this resistive opening 182 may not be present or there may be multiple front cavity openings/ports. Similarly, in this design a third resistive opening 186 is included on the rear, and opening 186 has a resistive element 188 to damp it. In other designs, this opening 186 may not have a resistive element 188 or there may be multiple rear cavity openings/ports (see, e.g., FIGS. 2, 4-7, 10).

The front transmission line or spout 178 may be an integral part of the housing 190, as depicted in FIG. 9A. It may also be a separate piece that could be removed/replaced by the user. The separate piece could be but need not be made of a compliant material (like silicone or another thermoplastic elastomer) to be more comfortable in case it contacts part of the ear, such as the tragus. The spout typically makes up some or all of the front transmission line. A removable spout can also enable a dual function: with the spout removed, the device could operate like a dipole with front and rear resonances matched and the ear would appear more visually open. With the spout attached, the ear would not be as visually open, but would have improved bass, loudness and spillage. Since the spout would shift the front resonance frequency lower, part of the spout mounting structure could be used to block either a portion of the one rear opening or one of multiple rear openings so that the rear resonance frequency would also lower to match, as in FIG. 10.

Figure 10:
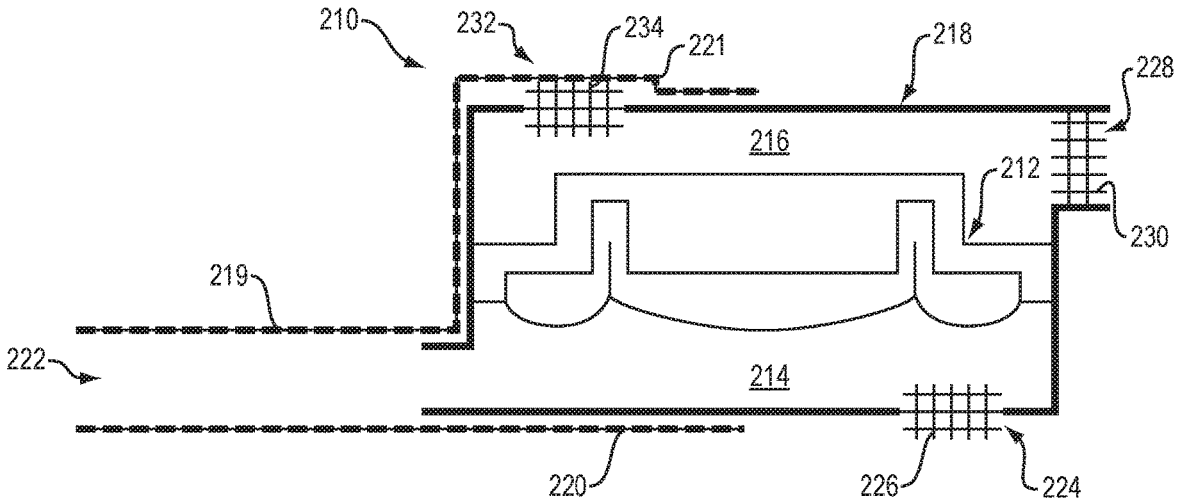
FIG. 10 is a schematic cross-sectional diagram of an open audio device.

FIG. 10 illustrates acoustic module 210 that includes transducer 212 that is located within housing 218. Transducer 212 radiates front-side acoustic radiation into front acoustic cavity 214 and rear-side acoustic radiation into rear acoustic cavity 216. Sound exits front cavity 214 via sound-emitting opening 222 that is at the end of transmission line 219. Front cavity 214 also includes second sound-emitting opening 224 with resistance element 226. Sound exits rear cavity 216 via opening 228 that is covered by resistance element 230. A second opening 232 that is covered by resistance element 234 is also open to rear cavity 216. Transmission line 219 in part functions to deliver front side sound farther from the transducer. In one non-limiting example opening 222 can be located closer to the ear canal entrance than housing 218. This allows the housing to be held off the ear while front side sound is still delivered very close to the ear canal.

In the example of FIG. 10 transmission line/spout 219 is a separate piece that is configured to be removably coupled to housing 218. Spout 219 can be configured such that portion 221 covers opening 232. As discussed above, this will help to lower the resonance of the rear cavity, ideally to match the lowering of the resonance frequency of front cavity 214 when spout 219 is coupled to housing 218 as shown in FIG. 10. While not shown in FIG. 10, spout 219 may be curved, as in FIG. 9A, or may take another shape.

In the dual function example of FIG. 10, the open audio device could be enabled to sense whether the spout is installed and adjust the audio accordingly for appropriate playback response; for example the audio signals may be adjusted by changing audio equalization or limiting parameters based on whether or not the spout is installed. Such adjustment may be necessary because the presence of the spout can change the transducer-to-ear transfer function and can load the transducer differently. Sensing of when the spout is coupled to the housing can be achieved in any desired manner. For example, an on-board microphone (not shown) either internal or external to the housing can be used to determine the transducer-to-microphone transfer function. Since the sound pressure increases around the cavity resonance frequency, a measure of this transfer function can be used to determine resonance and from this the state of the spout (on or off) can be inferred. Also, the transducer electrical impedance could be determined. At the cavity resonance the transducer impedance will have a peak that will shift in frequency as the resonance changes from the spout being either on or off. Therefore, the transducer impedance can be used as a measure of the resonance frequency and from this the state of the spout (on or off) can be inferred. Furthermore, various sensors could be used to determine if the spout is installed or not. For instance, a Hall effect sensor could be used to detect magnetic material in the spout to determine whether the spout is on or off. A capacitive sensor could be used to detect capacitive coupling to material in the spout to determine whether the spout is on or off. An optical sensor could be blocked or unblocked by the presence of the spout to determine whether the spout is on or off. A mechanical switch could be present that is triggered upon installation or removal of the spout. The housing could contain electrical contacts to form a circuit which is open when the spout is off and closed when the spout is on due to a conductive trace designed into the spout.

Figure 11:
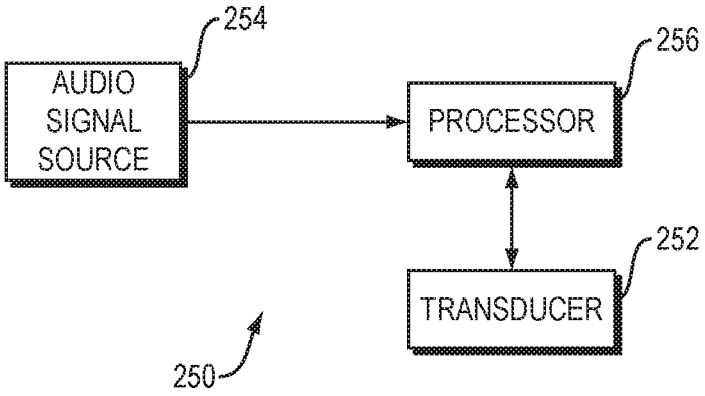
FIG. 11 is a functional block diagram of an audio signal control system for an open audio device.

FIG. 11 is a functional block diagram of an audio signal control system 250 that can be used for sensing when the spout is installed or not and adjusting the audio. Audio signals are provided by audio signal source 254. In an open-audio device the audio signals are typically (but not necessarily) provided from a source wirelessly (e.g., by Bluetooth or another wireless protocol). The audio signals are played by transducer 252. Processor 256 (which may be but need not be a digital signal processor) is responsive to the audio signals and the transducer, and if a microphone is used to sense sound pressure in the front and/or rear cavity processor 256 would be responsive to the microphone as well. A computer program implemented by the processor can be used to determine cavity resonance and thus the state of the spout, and make appropriate adjustments to the audio signals.

Elements of FIG. 11 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Examples of the systems and methods described herein comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other examples are within the scope of the following claims.

What is claimed is:

1. An open audio device, comprising:

a housing;

an acoustic radiator in the housing that emits front-side acoustic radiation from its front side and emits rear-side acoustic radiation from its rear side;

a front acoustic cavity located at least in part in the housing that receives front-side acoustic radiation and defines a first front sound-emitting opening that is configured to be located anteriorly of a user's ear canal opening;

a rear acoustic cavity located at least in part in the housing that receives rear-side acoustic radiation and defines at least a first rear sound-emitting opening and a separate second rear sound-emitting opening that is spaced from the first rear sound-emitting opening; and an elongated spout piece that is configured to be removably coupled to the housing such that it covers the first front sound-emitting opening and thereby lowers a resonance frequency of the front acoustic cavity, wherein the spout piece is configured to conduct sound from the first front sound-emitting opening to spout piece sound-emitting opening that is closer to the ear canal opening than is the first front sound-emitting opening, but is not in the ear canal opening, and wherein the spout piece is further configured to cover the second rear sound-emitting opening but not the first rear sound-emitting opening, and thereby lower a resonance frequency of the rear acoustic cavity.

2. The open audio device of claim 1, further comprising a second front sound-emitting opening that comprises a resistive element and is closer to the acoustic radiator than is the first front sound-emitting opening.

3. The open audio device of claim 2, wherein the first rear sound-emitting opening comprises a resistive element.

4. The open audio device of claim 1, further comprising a support structure that is configured to carry the acoustic radiator on a wearer's head such that the acoustic radiator is held proximate but not in an ear canal opening of the user.

5. The open audio device of claim 1, wherein at least one of the first and second rear sound-emitting openings comprises a resistive element.

6. The open audio device of claim 1, further comprising a processor that is configured to provide audio signals to the acoustic radiator.

7. The open audio device of claim 6, wherein the processor is configured to modify the audio signals based on whether the spout piece is coupled to the housing.

8. The open audio device of claim 1, wherein the spout piece is configured to locate the spout piece sound-emitting opening proximate but not in the ear canal opening.

9. The open audio device of claim 8, wherein the spout piece has a length and is curved along its length such that it is configured to pass over the ear tragus and locate the spout piece sound-emitting opening near but not in the ear canal opening.

10. The open audio device of claim 1, wherein the first front sound-emitting opening is configured to direct sound generally near the ear canal opening.

11. The open audio device of claim 1, wherein the second rear sound-emitting opening is closer to the ear canal opening than is the first rear sound-emitting opening.

12. The open audio device of claim 1, wherein at least one front sound-emitting opening comprises a resistive element.

13. The open audio device of claim 12, wherein a resistive element comprises a resistive screen.

14. The open audio device of claim 1, wherein at least one rear sound-emitting opening comprises a resistive element.

15. The open audio device of claim 14, wherein a resistive element comprises a resistive screen.

16. The open audio device of claim 1, further comprising a resistive opening that acoustically couples the front and rear acoustic cavities.

17. The open audio device of claim 1, wherein the housing is configured to be held on or proximate an ear of a user.

18. The open audio device of claim 1, wherein the front cavity and the spout piece together define a front fundamental resonance frequency and the rear cavity defines a rear fundamental resonance frequency, and wherein the front and rear fundamental resonance frequencies are within one octave of each other.

* * * * *